United States Patent [19]

Pinto

[11] Patent Number: 4,586,218

[45] Date of Patent: May 6, 1986

[54] CHUTE FEED APPARATUS FOR A CARDING MACHINE

[76] Inventor: Akiva Pinto, 524 Eastwood Dr., Gastonia, N.C. 28052

[21] Appl. No.: 655,974

[22] Filed: Sep. 28, 1984

[30] Foreign Application Priority Data

Oct. 7, 1983 [DE] Fed. Rep. of Germany ..... 3336517

[51] Int. Cl.[4] ..... D01G 15/00; D01G 9/06

[52] U.S. Cl. ..... 19/105

[58] Field of Search ..... 19/105, 85, 97.5, 200, 19/204, 86, 90, 96

[56] References Cited

U.S. PATENT DOCUMENTS

| | | | |
|---|---|---|---|
| 4,397,065 | 8/1983 | Bettoni et al. | 19/105 |
| 4,404,710 | 9/1983 | Wood | 19/105 |
| 4,520,530 | 6/1985 | Pinto | 19/105 |

FOREIGN PATENT DOCUMENTS

| | | | |
|---|---|---|---|
| 2248522 | 4/1974 | Fed. Rep. of Germany | 19/105 |

*Primary Examiner*—Werner H. Schroeder
*Assistant Examiner*—Andrew M. Falik
*Attorney, Agent, or Firm*—Cort Flint

[57] ABSTRACT

A chute feed means comprising upper and lower chutes intercommunicating through channelways between guide walls and a feed roller and a beater roller provides virtual elimination of stressing constituent fibers on the flock being processed by obviating all reversals in direction of movement of the flock through the chute feed means. This is the result of causing the feed roller and the beat roller to be rotated in opposite rotational senses to one another and by positioning the roller axes and guide walls such that the flow of flock through the intercommunicating channelways is made almost laminar.

9 Claims, 1 Drawing Figure

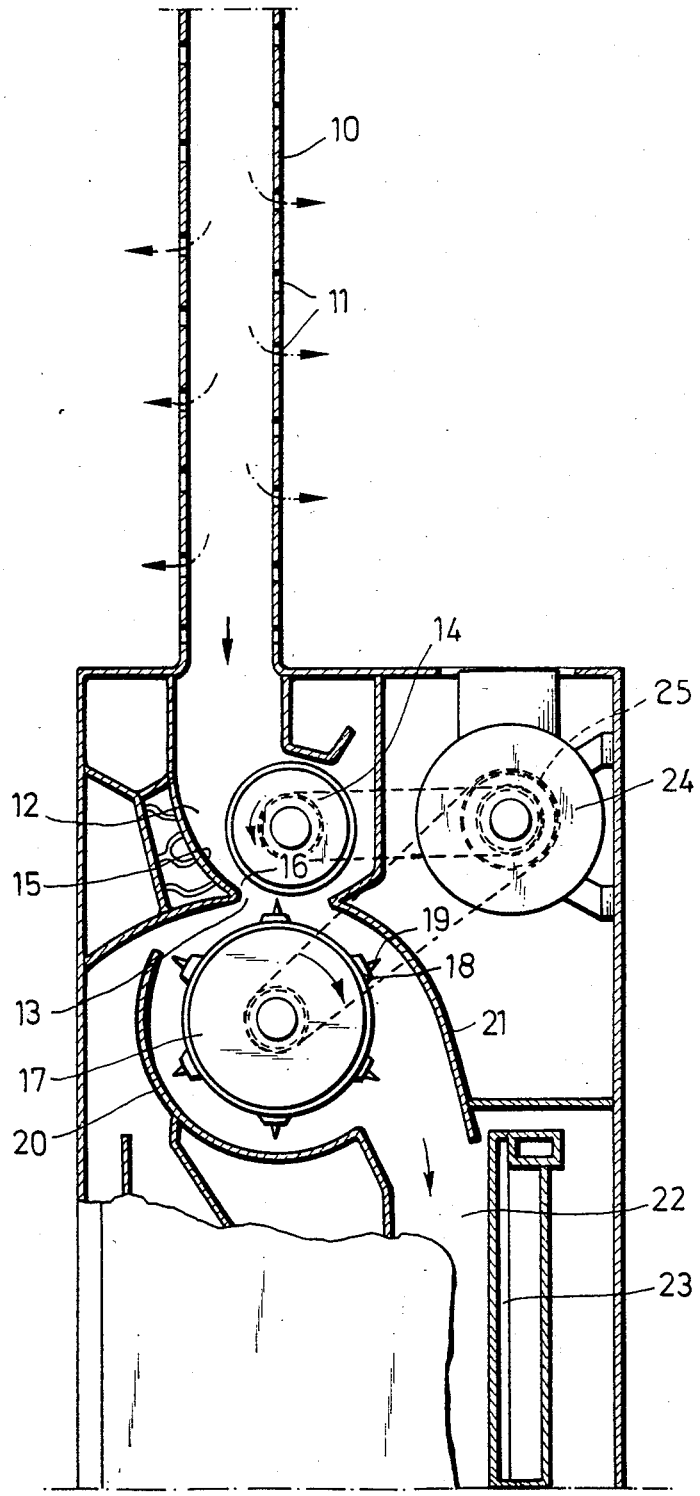
10
11
14
25
24
12
15
16
19
18
13
21
17
20
22
23

CHUTE FEED APPARATUS FOR A CARDING MACHINE

BACKGROUND OF THE INVENTION

This invention relates to improved means for the chute feeding of fibrous flock to carding machines, which means substantially reduces the "working" of the constituent staple fibers from what previously was known.

Staple fibers useful in textile end uses usually are received by commercial textile mills in a baled form. The bales then are opened and the fibers are removed therefrom in the form of clusters of fibrous flock by some device such as a bale opener machine, or bale discintegrator machine or the like. The flock clusters then are moved, usually by air flow as in the chute feed method, to a feeder device which feeds the fibers to a carding machine in the form of a somewhat compacted batt of fibers. The form of the batt and also of the individual fibers of the batt often determine the quality provided to the end product of the textile use process, usually a yarn to form woven or knit textile goods, or a nonwoven web. Uniformity of density of the batt is a desired goal. Also, providing constituent fibers in the least stressed form, which is to say fibers which have been subjected to the least amount of imposed stress possible, is another highly desired goal.

However, until the advent of this invention, fibers conveyed to carding machines by the chute feed method have invariably been subjected to severe, imposed stress. Often such stress causes the formation of hook-like ends to the individual staple fibers causing all manner of subsequent processing problems and reduced product quality. Yet other problems include a tendency for greater non-uniformity of properties in the end textile product.

It is to the assuagement of these problems to which the present invention is directed, such being an object thereof.

In the prior art of chute feeding, the fibrous flock received from the bale opener device via air currents enters the vertical fiber receiving chute to form a column therein. The column is supported at the bottom of the receiving chute by a horizontally disposed feed roller axially supported for rotational movement within a cup-like bottom channel of the receiving chute, the bottom of the cup being a somewhat restricted opening. The bottom wall portions of the cup-like channel are curved inwardly in spaced away relation to the surface of the feed roller to form a passageway for the flock being moved by the feed roller in its rotation. This passageway terminates in the aforesaid restricted opening, which latter communicates with the downwardly depending feed channel chute by way of a guide channel bounded by a guide wall and the surface of a beater roller. The beater roller is mounted or nests such that its rotational axis is substantially parallel to that of the feed roller and spaced away therefrom a sufficient distance that the beater ribs or vanes terminate at and intrude into the aforesaid restricted opening at the bottom of the receiving chute.

In operation, the feed roller receives flock from the bottom of the column in which it is in contact, and moves the flock by its rotation to and through the restricted opening. The beater roller, which is invariably rotated in the same rotational sense as the feed roller, receives flock entering the restricted opening thereabove and its vanes rotate the stock therewith. In so doing the fibrous stock is pressed strongly and sharply about the walls of the restriction of the bottom cup opening, subjecting the constituent fibers to high shear and pulling stresses before being dropped into the feed channel chute for subsequent delivery to the feed roll of a carding machine. The shear, bending and elongation stresses imposed upon the fibers by the aforementioned process produce fibers which are, in the art used expression, strongly "worked."

SUMMARY OF THE INVENTION

An improved chute feed means of the invention comprises, in substantially vertical disposition, a fibrous flock receiving channel chute, and a feed channel chute therebeneath, a feed roller and a beater roller positioned intermediate said chutes and enclosed so as to provide a continuous intercommunicating channelway from the top of the receiving channel chute to the bottom of the feed channel chute, the walls of said chutes forming a restricted opening therebetween with the feed roller mounted for rotation above the walls constriction and the beater roller mounted for rotation below the walls constriction with the vanes of the beater roller interpenetrating the restricted opening, the improvement comprising mounting said feed roller and said beater roller for counterrotation in respect to one another.

By such respective rotations of the feed and beater rollers, which are on end view in opposite rotational senses to one another, the fibrous flock is moved smoothly, virtually in a laminar manner around the side and bottom of the feed roller across the top and down the other side of the beater roller to fall in a slightly compacted form, virtually unstretched and non-stressed atop previously delivered portions of flock in the feed channel chute for subsequent feed to a carding machine.

THE DRAWING

The single FIGURE shows, in side elevation, partially in section, a chute feed means of the invention.

DESCRIPTION OF A PREFERRED EMBODIMENT

As illustrated in the FIGURE, present chute feed means includes a fiber flock receiving channel chute 10, into which fibrous flock of staple fibers are fed via air flow from a previous machine (not shown). A plurality of vents 11 may be provided in the walls of the upper chute 10 to permit movement of the fiber-conveying air as the flock drops by gravity and air pressure atop a feed roller 14 mounted adjacent to the bottom portion of chute 10 in a cup-like channelled enclosure trough 12 bounded by a wall 15.

Trough 12 terminates in a restricted bottom opening 13 which is defined in part by the bottom portion of wall 15 and the lower portion of feed roller 14 to form a progressively narrowing channelway 16 terminating in opening 13. Feed roller 14 is mounted within trough 12 upon an axial shaft (unnumbered) substantially parallel to the long dimension of trough 12, namely into the paper, and along a plane which substantially bisects restricted opening 13. Beneath opening 13 is mounted a beater roller 17, of cylindrical configuration, having its rotational axis substantially parallel to that of roller 14 but residing in a vertical plane offset toward wall 15 from the aforesaid plane bisecting opening 13 and in which the rotational axis of feed roller 14 resides. Roller 17 itself is mounted such that needles 19 which project from a plurality of peripheral ribs 18 about roller 17 protrude into restricted opening 13 into close and yet spaced away adjacency to the bottom portions of feed roller 14. As shown by the arrows, the rotational movement of rollers 14 and 17 are in opposite rotational senses to one another. In the FIGURE, roller 14 is shown to rotate in a counterclockwise direction, but roller 17 rotates in a clockwise direction. This is essential to the construction of the present chute feed means in accordance with the invention.

One may clearly see that fibrous flock received by upper chute 10 is progressively moved through trough 12 and its progressively narrowing channelway 16 by rotation of feed roller 14, to and out of restricted opening 13 into contact with the interprojecting needles 19 of beater roller 17. This construction coupled with the counterrotation of roller 17 relative to the rotation of roller 14 permits the flock to move smoothly in a continued non-tortuous manner, as shown in the drawing, downwardly and toward the right to enter the lower channel, embodied as a feed chute 22. This construction provides for minimal stress imparted to the fibers as they are moved along.

As shown, upper chute 10 and lower chute 22 although vertically disposed one atop the other are arranged so that the flock may be moved progressively downwardly and to the right; thus trough 12 is disposed below and somewhat to the right of chute 10 with feed roller 14 mounted therewithin also disposed to the right of chute 10, such that channelway 16, defined in part by the left hand descending portion of the surface of roller 14 and wall 15, is substantially in line with the vertical center of chute 10. The progressive narrowing of channelway 16 occasioned by the curvilinear approach of wall 15 toward the cylindrical peripheral surface of feed roller 14 causes a slight compaction of the fibrous flock as roller 14 moves it through channelway 16, and also causes the flock to change direction from downward vertically to downward towards the right in a most smooth and gentle manner. Then, flock exiting channelway 16 through restricted opening 13 is received by needles 19 and beater roller 17 in its movement toward the right, and moved further to the right and then smoothly and progressively downward following the curvature of direction of rotation of roller 17 thence to fall into lower feed chute 22. Beater roller 17 is mounted as described to nest between curvilinear walls 20 and 21, the guide surfaces of which help control the agitative regime of air flow within the chute feed apparatus so as to minimize disruption of movement of the fibrous flock by air currents generated by the rotating rollers. To observe flock collecting in lower feed chute 22, one may provide a glass or otherwise transparent viewing plate 23. Conventionally, if desired, one may wrap the cylindrical surfaces of feed roller 14 with card clothing wire, providing pointed grasping surfaces to help move the flock along and through channelway 16.

In respect to the action of rotation of needles 19 relative the movement of flock to and through constricted opening 13, one may note that as it passes the downwardly depending end of wall 15, which in part defines opening 13, needles 19 pass closely adjacent thereto in a prescribed spaced away distance. The spacing may be adjusted by varying as desired the length of needles 19 to accommodate flocks of different consistencies, densities, or other significant properties in moving the flock from such wall end and out of opening 13, into the channelway defined by the right depending portion of roller 17 and the inner surface of wall 21.

Means for rotating feed roller 14 in a direction toward the upper portion of guide wall 15 and then adjacent thereto and then away from the bottom end of wall 15, and for rotating beater roller 17 in the opposite rotational sense from that in which roller 14 rotates, which is to say toward the end of guide wall 15, and then in spaced away adjacency to roller 14 while needles 19 interpenetrate constricted opening 13 and then away from opening 13, may be provided in any conventional, known manner, such as by a motor 24 driving such rollers for their prescribed modes of rotation and anti-rotation, such as through some gearing (not shown) or the like such as the conventional belt means 25.

I claim:

1. In chute feed apparatus for processing fibrous flock to a batt for feeding to a carding machine, and comprising upper and lower chutes, rotatable feed and beater rollers, and a plurality of guide walls, said upper and lower chutes intercommunicating with one another through intermediate channelways wherein the improvement comprises:

a first channelway being defined between a descending surface of said rotatable feed roller and an adjacent spaced-away curved first guide wall, an exit opening defined at least in part by a lower terminal portion of said first guide wall;

a second channelway defined between the ascending surface of said beater roller and a terminal portion of said first guide wall, and said second channelway being further defined between the descending portion of the surface of said beater roller and a descending adjacent portion of a second curved guide wall, and means for rotating said rollers;

said feed roller being disposed adjacently above a restricted opening formed between said upper and lower chutes and adjacent said exit opening;

means for rotating said feed roller in a direction toward the bottom of said upper chute toward said first guide wall and said exit opening;

said beater roll being disposed adjacent the top opening of said lower chute and below said exit restricted opening in a manner that said beater roll is offset in its position relative to said exit opening toward said first guide wall; and means for rotating said beater roll in a direction toward said lower terminal portion of said first guide wall, toward said restricted opening, and thereafter away from said restricted opening toward the top portion of the second guide wall adjacent said decending portion of said second guide wall.

2. The improvement according to claim 1 wherein said means for rotating said rollers comprises means for rotating said feed roller in one rotational direction, and means for rotating said beater roller in an opposite rotational direction from that of rotation of said feed roller.

3. The improvement as in claim 2 wherein said means for rotating said rollers includes a motor.

4. The improvement as in claim 2 wherein said rollers are mounted for rotation on shafts having axes of rotation substantially parallel to one another and residing in a plane offset from one another.

5. The improvement as in claim 4 wherein said plane extends from said rotational axis of said feed roller to said rotational axis of said beater roller, and is canted toward said lower terminal portion of said first guide wall.

6. The improvement as in claim 2 wherein said beater roller has radially disposed projections protruding from its surface which penetrate said restricted opening upon roller rotation closely adjacent the periphery of said feed roller.

7. The improvement as in claim 2 wherein said first guide wall adjacent said feed roller is spaced away from the axis of rotation of said roller by a prescribed amount greater than the distance separating said terminal portion of said first guide wall and said axis, whereby said first channelway defined between the surface of said feed roller and said first guide wall progressively narrows.

8. A chute feed for a carding machine comprising upper and lower chutes communicating through channelways a first channelway defined between a first curved guide wall and a rotating feed roller located at the bottom of said upper chute, a second channelway defined between a second curved guide wall and a rotating beater roll located adjacent the top of said lower chute, and a restricted opening defined between a terminal portion of said first guide wall and an initial portion of said second guide wall having an exit point through which fiber passes from said first channelway to said second channelway, wherein the improvement comprises:

said first channelway being generally in line with a vertical center axis of said upper chute;

a first rotational axis about which said feed roll rotates, a second rotational axis about which said beater roll rotates, said second rotational axis of said beater roll being parallel to said first rotational axis of said feeder roll, and said first rotational axis of said beater roll lying in a vertical plane which is offset toward said first guide wall from a vertical plane in which said first rotational axis of said feed roll resides; and said fiber received by said upper chute may be progressively moved through said first channelway, restricted opening, and second channelway by rotation of said feed roller and said beater roller in a smooth continuous untortuous manner in which minimal stress is imparted to the fibers; and said feeder roll and beater roll being rotated in directions in such a manner that fiber from the exit point of said restricted opening exits between the feed roll and the terminal end of said first guide wall, and the fiber material is further conveyed by the beater roll in the same direction in which it leaves the exit point.

9. The apparatus of claim 8 wherein said beater roller and feed roller rotate in the opposite directions.

* * * * *